United States Patent [19]

Albrecht et al.

[11] Patent Number: 4,518,444

[45] Date of Patent: May 21, 1985

[54] MATERIAL WHICH IS AT LEAST PARTIALLY MADE FROM A CONSTITUENT HAVING A ONE-WAY SHAPE MEMORY EFFECT AND PROCESS TO PRODUCE SAID MATERIAL

[75] Inventors: Joachim Albrecht, Mülligen; Thomas Duerig, Nussbaumen, both of Switzerland

[73] Assignee: BBC Brown, Boveri & Company Limited, Baden, Switzerland

[21] Appl. No.: 402,274

[22] Filed: Jul. 27, 1982

[30] Foreign Application Priority Data

Feb. 5, 1982 [CH] Switzerland ..... 706/82

[51] Int. Cl.[3] ..... C23C 9/00

[52] U.S. Cl. ..... 148/402; 228/263.18; 204/37.1; 75/246; 428/615; 428/616; 428/617; 428/618; 428/625; 428/626; 428/548; 148/6; 148/38

[58] Field of Search ..... 148/402, 411, 432, 31.5; 428/615, 616, 617, 618, 625, 626, 457, 458, 548; 75/200, 201, 246, 247; 228/263.18, 263.13; 419/6.38, 49, 28; 204/49, 37 R

[56] References Cited

U.S. PATENT DOCUMENTS

| | | | |
|---|---|---|---|
| 3,243,211 | 3/1960 | Wetmore | 428/960 |
| 3,872,573 | 3/1975 | Nichois et al. | 428/960 |
| 4,197,880 | 4/1980 | Cordia | 428/960 |
| 4,310,354 | 1/1982 | Fountain et al. | 428/960 |

FOREIGN PATENT DOCUMENTS

| | | | |
|---|---|---|---|
| 2004546 | 8/1971 | Fed. Rep. of Germany | 428/960 |
| 2724539 | 11/1978 | Fed. Rep. of Germany | 428/960 |
| 7513323 | 4/1975 | France | 428/960 |

OTHER PUBLICATIONS

Encyclopedia of Chemical Technology, 3rd ed., vol. 20, 1982.

*Primary Examiner*—L. Dewayne Rutledge
*Assistant Examiner*—Debbie Yee
*Attorney, Agent, or Firm*—Oblon, Fisher Spivak, McClelland and Maier

[57] ABSTRACT

Material, in the form of bars, tubes, profiles, wires, sheets, or bands, which is, at least partially, composed of a constituent showing a one-way shape memory effect, and a further inactive constituent hindering the one-way effect of the first, and which collectively exhibits a significant two-way effect. The one-way shape memory constituent can be a Cu-Al-Ni, Cu-Al, TiV, Ti-Nb, Ni-Ti, or Ni-Ti-Cu alloy. Production of bi- or multi-constituent components by brazing, welding, roll bonding, extruding, powder metallurgical methods, hot isostatic pressing, or gluing, or by the application of metallic coatings (2) onto a core material (1) and subsequent diffusion treatment to produce an inactive surface layer (3).

15 Claims, 2 Drawing Figures

Figure 1A:
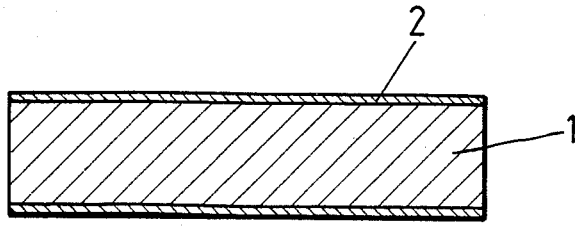

MATERIAL WHICH IS AT LEAST PARTIALLY MADE FROM A CONSTITUENT HAVING A ONE-WAY SHAPE MEMORY EFFECT AND PROCESS TO PRODUCE SAID MATERIAL

This invention relates to a composition exhibiting a two-way memory effect, comprising an alloy base exhibiting a one-way memory effect, the surface of which is altered by incorporation of a material in or around that layer which resists the one-way shape memory effect, thereby converting the composition to a two-way memory effect.

With memory alloys in general, the difference between the so-called two-way effect and the one-way effect must be distinguished. While the latter is generally more pronounced, better known (e.g.—Ni-Ti and the $\beta$-brasses) and has led to numerous applications, the two-way effect is more problematic and difficult to control. There is, however, a common technological demand for components which show a two-way effect of sufficient magnitude to open further interesting fields of application. Usually the temperature of the martensitic transformation in the classical two-way shape memory alloys falls into an undesirable temperature range. There are, however, a number of shape memory alloys, especially the the $\beta$-brasses such as the classical Cu-Al-Ni and Cu-Al alloys, which have a suitable transformation temperature; these alloys have a remarkable one-way effect, but a negligible two-way effect.

The following documents can be quoted as "state of the art":

R. Haynes, Some Observations on Isothermal Transformations of Eutectoid Aluminium Bronzes Below their $M_s$—Temperatures, Journal of the Institute of Metals 1954–1955, Vol. 83, pages 357–358; W. A. Rachinger, A "Super Elastic" Single Crystal Calibration Bar, British Journal of Applied Physics, Vol. 9, June 1958, pages 250–252; R. P. Jewett, D. J. Mack, Further Investigation of Cu-Al Alloys in the Temperature Range Below the $\beta$ to $\alpha+\gamma_2$ Eutectoid, Journal of the Institute of Metals, 1963–1964, Vol. 92, pages 59–61; K. Otsuka and K. Shimizu, Memory Effect and Thermoelastic Martensite Transformation in Cu-Al-Ni Alloy, Scripta Metallurgical, Vol. 4, 1970, pages 469–472; K. Otsuka, Origin of Memory Effect in Cu-Al-Ni Alloy, Japanese Journal of Applied Physics, Vol. 10, no.5, May 1971, pages 571–579.

There is, therefore, a demand for components made from shape memory alloys of the $\beta$-brass type, which have a transformation temperature suitable for certain specific applications, while exhibiting a noticeable two-way effect. The purpose of this invention is to develop a new material on the basis of Cu-Al-Ni and Cu-Al alloys, as well as an appropriate process for the production of said material, which shows a considerable reversible two-way shape memory effect and is suitable for the fabrication of semi-finished products in the form of bars, profiles, and sheets, as well as for the production of components which can be used for practical applications. This goal is achieved by the features indicated in claim 1 and claim 5.

The invention will be described in the following working examples and illustrated in the attached diagrams.

The figures show:

FIG. 1—The structure of the material in the form of semi-finished product (bar).

Figure 2:
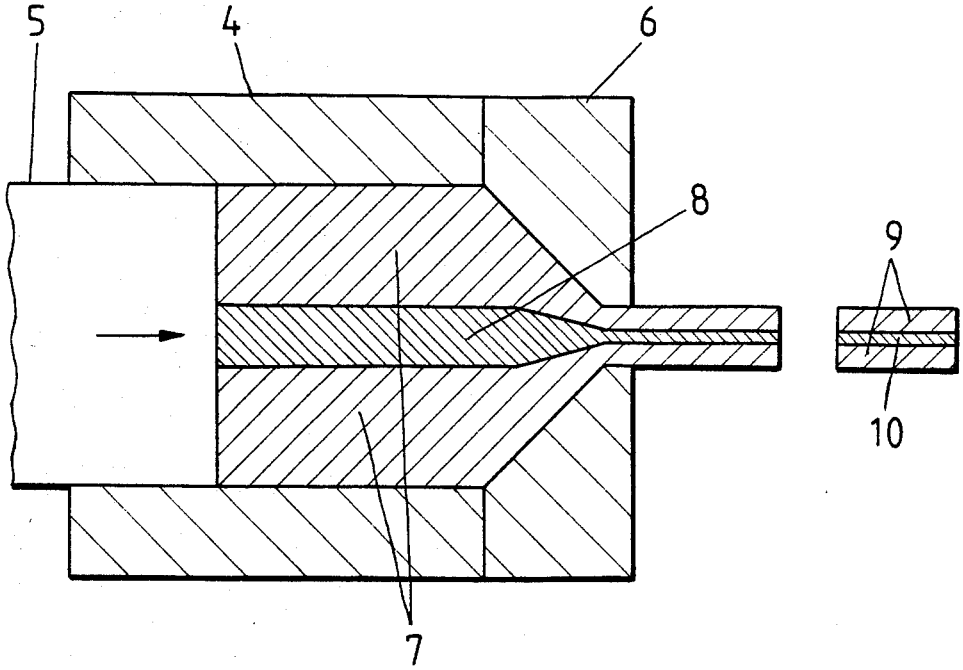

FIG. 2—The process of extrusion as a method of production of the material in the form of a trimetal.

Figure 1B:
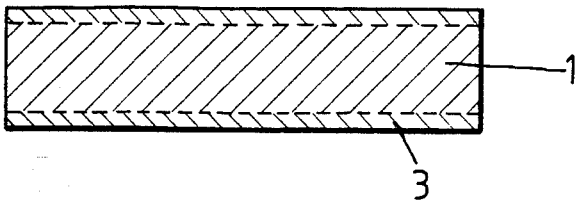

FIG. 1 is the cross-section of a bar made from the said material. FIG. 1*a* shows the condition after the first processing step, while FIG. 1*b* shows the finished product. The part labeled 1 in FIG. 1 is the component showing the one-way shape memory effect, the part labeled 2 represents a metallic coating. Finally, the component labeled 3 is formed as a surface layer (inactive zone) by means of a diffusion treatment.

FIG. 2 illustrates a process to produce trimetal bars or strips. The part labeled 4 is the cylinder of an extrusion press, 5 is the corresponding plunger, and 6 the die (which, for practical purposes, should have a comparatively small angle of extrusion). The details labeled 7 are the outer parts of the component to be extruded having a one-way effect. The part labeled 8 shows the inner core of another constituent of the entire piece having no shape memory effect. The cross-section of the finished bar is illustrated on the right of the main figure, where 9 represents the outer layers (having a one-way effect), and 10 represents the core (inactive constituent).

WORKING EXAMPLE I

See FIG. 1

The constituent having the one-way shape memory effect was of the $\beta$-brass class of memory alloys, and was produced by powder metallurgical means with the following composition:

Al: 14.2 wt. %
Ni: 3.2 wt. %
Cu: balance

The memory alloy was hot rolled to a strip thickness of 2.5 mm. Then a bar of 2.5 mm by 2.5 mm square cross-section and length of 35 mm was cut from the original strip. The bar showing the one-way effect was then coated on two opposing faces (here, the rolling faces) with a metallic layer (here, nickel). The coating was done by an electroless chemical process by immersing the bar into a bath for 6 hours at a temperature of 80° C. The trade name of the solution was "Electroless Nickel" (producer: Oxy Metal Industries, Suisse, SA, Avenches). The coated bar was then heat treated at a temperature of 900° C. for 30 minutes and water quenched. During this treatment, the nickel diffused into the Cu-Al-Ni core and formed an inactive surface layer (constituent 3 in FIG. 1). This treatment changes the metallurgical composition of the surface zone with respect to the core, and concomitantly, the physical properties. The diffusion zone thereby lost the physical properties of the classical memory alloy; or if the properties were present, they were not operative in the same temperature range as befoe the diffusional treatment. The surface was, however, left in a highly elastic condition. Considerable reversible two-way shape memory effects were realized through such a treatment.

WORKING EXAMPLE II

See FIG. II.

The same material described in Example I was used in this trial. A prismatic body was cut out and layered with a strip of corrosion resistant steel (18Cr-8Ni) to produce a sandwich according to items 7 and 8 of FIG. 2. This rectangular form was placed into an extrusion press and extruded at 800° C. into a composite material in the shape of a strip. This type of trimetal can be produced in practically any cross-sectional shape or length. A notable two-way effect was thus observed.

WORKING EXAMPLE III

The same starting materials as described in Example 2 were used in this case (Cu-Al-Ni and Cr-Ni steel). A rod of Cr-Ni steel was positioned in the center of a cylindrical mild steel capsule with a height of 200 mm, an outer diameter of 80 mm and 2 mm wall thickness. The capsule was then filled with Cu-Al-Ni powder, evacuated, sealed, and hipped at 950° C. for 3 hours at a pressure of 140 MPa. After hipping, the mild steel capsule was removed, and the pressed composite rod swaged in several steps to its final dimensions at a temperature of 850° C.

WORKING EXAMPLE IV

The starting memory material in this example was of the composition:

Al: 13.2 wt. %
Ni: 3.2 wt. %
Cu: balance

An alloy of the following composition was used for the second constituent (inactive superelastic material):

Ti: 42.25 wt. %
Ni: 47.25 wt. %
Cu: 5. wt. %
Fe: 5. wt. %

First a rod of 20 mm diameter was produced by powder metallurgical methods from the Cu-Al-Ni alloy by pressing and sintering. A tube with an inside diameter of 20 mm and a wall thickness of 2 mm was machined from the Ni-Ti-Cu-Fe alloy and the Cu-Al-Ni rod was fitted tightly into the tube. The composite was then heated to a temperature of 850° C. and swaged in several steps to a diameter of 10 mm. The cross-sectional reduction per swaging step was 20%. The swaging produced a rigid, compact, composite material exhibiting a notable two-way effect. It should be emphasized that only the superelastic behavior of the second constituent (Ni-Ti-Cu-Fe) is used, and not the shape memory effect which can occur in this material in a different temperature range.

The above examples are but a few of the possible applications of the invention. In principle, the material consists of several layers (at least two), one (or more) of which is a one-way shape memory alloy while the others are inactive layers resisting the one-way shape memory movement by effectively forming an internal spring. This condition can be fulfilled internally in the memory element, or externally while in service, by stipulating the load and temperature seen by the service of the element. The material can be produced in the form of semi-finished products in the form of bars, wires, tubes, profiles, sheets, or bands, and can be machined into components while cold. For the first (active) component, all one-way alloys can be used, particularly Cu-Al-Ni, Cu-Al, Cu-Zn-Al, Ti-V, Ti-Nb, Ni-Ti, and Ni-Ti-Cu alloys. Another possibility is to use the same type of materials for the various layers, whereupon the transitions can be subtle. The compositions and physical properties (especially with regard to the shape memory effect) of the individual layers must be different. This can be achieved, for example, by increasing the Ni content of the surface and near-surface region, whereby the plateau of the superelastic strain is shifted into a different stress range. The one-way effect is thereby hindered and cannot proceed to completion. The result is a two-way effect.

Several processes can be used to join the constituents of different properties, such as brazing, welding, roll bonding, extruding or other metallurgical processes (as well as gluing). In this way, two layer (bimetal) or three layer (trimetal) materials can be produced. The materal can be powder metallurgically produced from the individual components by cold consolidation, sintering and extrusion, or by hot isostatic pressing followed by hot swaging (if necessary). Simultaneously or subsequently, a corrosion protection layer can be applied, with a thickness of 5-100 microns, or it can be generated in the surface zone. The latter is naturally possible for all processing procedures. The composite is not restricted to metallic constituents; the inactive second constituent can be a high strength, highly elastic, heat resistant polymer, which in itself can be a composite material (including, for example, fiber reinforcements). The condition is that the polymer sustains the elastic movements and the service temperatures without degradation.

The new material and the corresponding production process widens the field of application of the two-way shape memory effect—especially in the temperature range of 100°–200° C. This is especially important for switching, relay and temperature sensor applications.

We claim:

1. An article exhibiting a two-way shape memory effect, which is comprised of a one-way shape memory constituent having at least two regions, wherein said constituent is caused to exhibit a two-way shape memory effect by the presence of a second constituent which induces stresses resisting said one-way memory effect in at least one of said two regions, said second constituent being caused to be present in said article by at least one of brazing, welding, roll bonding, extrusion or hot isostatic pressing.

2. Article according to claim 1 in the form of bars, wires, profiles, sheets, or bands which can be machined into components at least in the cold condition.

3. Article according to claim 1 in which the shape memory constituent consists of a Cu-Al-Ni, Cu-Al, Cu-Zn-Al, Ti-V, Ti-Nb, Ni-Ti, or Ni-Ti-Cu alloy.

4. Article according to claim 1 in which the regions consist of the same type of alloy, but with a difference in chemical composition and different memory properties, constructed so that at least one region suppresses the one-way effect of the other region or regions.

5. A process for producing an article, exhibiting a two-way shape memory effect comprising bonding a constituent having a one-way shape memory effect with at least one other constituent exhibiting a high elasticity said bonding comprising at least one of brazing, welding, roll bonding, extruding or hot isostatic pressing.

6. Process according to claim 5 whereby a two-component article in the form of a bimetal is produced by joining a constituent showing a one-way shape memory effect with some other constituent.

7. Process according to claim 5 whereby a three-component article in the form of a trimetal is produced by joining a constituent showing a one-way shape memory effect to two other constituents.

8. Process according to claim 5 further comprising bonding one or two layers of a highly elastic, high strength polymer constituent, which, in itself, can be composed of various constituents, to said one-way shape memory constituent to form a multiple constituent article.

9. Process according to claim 5 whereby the constituent showing a one-way shape memory effect is used as a core material (1), the surface of which is metallurgically modified by diffusion thereinto of a second constituent so that a surface layer acting as the other constituent (3) (with different physical properties than that of the core) is formed.

10. Process according to claim 9, whereby the surface layer (3) is formed by applying a metallic coating (2) followed by a diffusion treatment.

11. Process according to claim 10, whereby the constituent used as a core material (1) is a Cu-Al-Ni or Cu-Al alloy and the surface zone (3) is produced by the application of a galvanic coating (2) of nickel with a subsequent diffusion treatment at a temperature of 900° C. for 30 minutes.

12. Process according to claim 5 whereby the material is powder metallurgically produced from the individual components and machined into bimetal or trimetal, semifinished products.

13. Process according to claim 12 whereby the article is produced by cold consolidation of mixed powders of said constituents, sintering, and extruding, or by hot isostatic pressing of the mixed powders of said constituents, resulting in the formation of said regions.

14. Process according to claim 5 whereby the article is coated with a corrosion protection layer of 5 to 100 micron thickness during or after its manufacture.

15. The process according to claim 13, wherein said hot isostatic pressing is followed by swaging of the mixed powders.

* * * * *